US010362380B2

(12) United States Patent
Ito et al.

(10) Patent No.: US 10,362,380 B2
(45) Date of Patent: Jul. 23, 2019

(54) HEADPHONE

(71) Applicant: Onkyo Corporation, Osaka (JP)

(72) Inventors: Masanori Ito, Osaka (JP); Takashi Ouchi, Osaka (JP)

(73) Assignee: Onkyo Corporation, Osaka (JP)

( * ) Notice: Subject to any disclaimer, the term of this patent is extended or adjusted under 35 U.S.C. 154(b) by 0 days.

(21) Appl. No.: 15/792,823

(22) Filed: Oct. 25, 2017

(65) Prior Publication Data

US 2018/0124488 A1 May 3, 2018

(30) Foreign Application Priority Data

Oct. 28, 2016 (JP) ..... 2016-211153

(51) Int. Cl.

| | |
|---|---|
| ***H04R 1/10*** | (2006.01) |
| ***H04R 5/033*** | (2006.01) |
| ***H04R 1/22*** | (2006.01) |
| *H04R 1/28* | (2006.01) |
| *H04R 27/00* | (2006.01) |

(52) U.S. Cl.

CPC ..... *H04R 1/1008* (2013.01); *H04R 1/1058* (2013.01); *H04R 1/22* (2013.01); *H04R 5/033* (2013.01); *H04R 1/2811* (2013.01); *H04R 27/00* (2013.01); *H04R 2420/07* (2013.01); *H04R 2499/13* (2013.01)

(58) Field of Classification Search

CPC .. H04R 1/1008; H04R 1/1016; H04R 1/1058; H04R 1/22; H04R 1/2811; H04R 1/2823; H04R 1/2857; H04R 5/033; H04R 2420/07

USPC ..... 381/309, 345, 346, 350, 370, 371, 372, 381/373, 374, 376, 380; 379/430, 431, 379/432; 181/129, 135

See application file for complete search history.

(56) References Cited

U.S. PATENT DOCUMENTS 4,742,887 A * 5/1988 Yamagishi ..... H04R 1/2857 181/129
7,391,878 B2 * 6/2008 Liao ..... H04R 5/033 381/370

FOREIGN PATENT DOCUMENTS

JP H07-170591 A 7/1995
JP 5902202 B 4/2016

* cited by examiner

*Primary Examiner* — Huyen D Le
(74) *Attorney, Agent, or Firm* — Renner, Otto, Boisselle & Sklar, LLP

(57) ABSTRACT

The present invention relates to a headphone including a housing defining a back chamber on a back side of a speaker unit. A headphone includes a speaker unit and a housing defining an internal space provided on an acoustic emission side as a back side of the housed speaker unit and an air chamber provided separately from the internal space. The housing includes a first housing member provided with a first hole allowing communication between an exterior and the air chamber, a second housing member attached to the speaker unit and coupled to the first housing member to define the internal space and the air chamber, and a third housing member fixed with the third housing member being sandwiched between the first and second housing members and provided with a second hole allowing communication between the air chamber and the internal space.

8 Claims, 3 Drawing Sheets

HEADPHONE

BACKGROUND OF THE INVENTION

1. Field of the Invention

The present invention relates to a headphone and an earphone attached to a user's ear to reproduce sound, and specifically relates to a headphone including a housing defining a back chamber on a back side of a speaker unit.

2. Description of the Related Art

Headphones each include a speaker unit, a housing surrounding a back side of the speaker unit, and an ear contact portion provided on a front side of the speaker unit. The headphones described herein include not only headphones configured such that a pair of right and left housings is coupled through a headband etc., but also earphone type headphones configured such that housings are directly supported on user's ears and a so-called headset configured such that a housing includes a microphone device.

Headphones configured such that a hole is formed at each housing to allow communication between a space in the housing and the exterior have been known as the above-described types of headphones. JP-A-7-170591 describes that for the purpose of improving response in a low sound range by a change in an acoustic equivalent circuit on a back side of an acoustic transducer (a speaker unit) without a change in an acoustic transducer structure, a housing attached to the acoustic transducer includes a duct portion for emitting, to the exterior, sound output from a back surface of the acoustic transducer.

In a case where the hole is, in each headphone, formed at the housing surrounding the back side of the speaker unit such that the space in the housing and the exterior communicate with each other, external noise tends to enter the space in the housing. The noise having entered the housing passes through a speaker unit component exhibiting air permeability, such as a diaphragm or an acoustic filter, and then, reaches a listener's ear. In this case, a listener hears not only the sound output from the speaker unit, but also the external noise. For this reason, there is a problem that the listener cannot clearly hear the reproduced sound of the speaker unit.

Japanese Patent No. 5902202 describes the following headphones as one example of challenges for solving the above-described problem: for, e.g., a purpose that a listener can hear less external noise in the case of allowing communication between the exterior and a space in each housing surrounding a back side of a speaker unit, an internal space and an air chamber formed separately from the internal space are provided in the housing; a space on the inside of an ear contact portion communicates with the inside of the ear of the listener, and communicates with the exterior through the air chamber and the internal space; the air chamber is formed by opposing outer and inner peripheral wall portions of the housing; the outer peripheral wall portion is provided with first holes communicating with the exterior; the inner peripheral wall portion is provided with second holes communicating with the internal space of the housing; and the first and second holes are at different positions along an outer peripheral portion of the housing with the first and second holes not facing each other.

However, in the headphones of Japanese Patent No. 5902202, the second holes (a reference number 35 of FIG. 3) formed at the inner peripheral wall portion of the housing 2 cannot form holes longer than the thickness dimension of an inner wall portion 32, leading to a problem that there is a limitation on acoustic property designing. Moreover, the second holes are formed in such a manner that a coupling member and a housing member are coupled together, each of the coupling member and the housing member being partially recessed corresponding to the holes. Thus, the positions of the facing recesses might shift from each other due to problems on dimension accuracy of components forming the housing and assembly dimension accuracy of the housing. This leads to a problem that the opening dimension and length of the second hole is less stable. As a result, there is a problem that it is difficult for headphones to exhibit excellent reproduced sound quality and stable quality.

SUMMARY OF THE INVENTION

The present invention has been made to solve the above-described problems of the typical technique, and an object of the present invention is to provide a headphone including a housing defining a back chamber on a back side of a speaker unit, the headphone realizing a long stable shape of a second hole formed at an inner wall portion of a housing and exhibiting excellent reproduced sound quality and stable quality.

The headphone of the present invention includes a speaker unit, and a housing defining an internal space provided on an acoustic emission side as a back side of the housed speaker unit and an air chamber provided separately from the internal space. The housing includes a first housing member provided with a first hole allowing communication between the exterior and the air chamber, a second housing member attached to the speaker unit and coupled to the first housing member to define the internal space and the air chamber, and a third housing member fixed with the third housing member being sandwiched between the first and second housing members and provided with a second hole allowing communication between the air chamber and the internal space.

Preferably, in the headphone of the present invention, the first housing member and the second housing member define an inner wall portion dividing the air chamber and the internal space from each other. Preferably, the third housing member is a substantially cubic member of which one side length is longer than the thickness dimension t2 of the inner wall portion, and is provided with the second hole defining a through-hole having a longer entire length than the thickness dimension t2.

Preferably, in the headphone of the present invention, the third housing member has a groove portion in which a cutout portion of the inner wall portion is fitted.

Preferably, in the headphone of the present invention, the housing further includes a fourth housing member fixed with the fourth housing member being sandwiched between the first and second housing members. Preferably, instead of the first housing member, the fourth housing member is provided with the first hole allowing communication between the exterior and the air chamber.

Preferably, in the headphone of the present invention, the first housing member and the second housing member define an outer wall portion dividing the exterior and the air chamber from each other. Preferably, the fourth housing member is a substantially cubic member of which one side length is longer than the thickness dimension t1 of the outer wall portion, and is provided with the first hole defining a through-hole having a longer entire length than the thickness dimension t1.

Preferably, in the headphone of the present invention, the fourth housing member has a groove portion in which a cutout portion of the outer wall portion is fitted.

Preferably, the headphone of the present invention further includes an annular ear contact portion attached to the housing on the acoustic emission side of the speaker unit. The housing and the ear contact portion define a space on the inside of the ear contact portion, the space communicating with the inside of a listener's ear and communicating with the exterior through the air chamber and the internal space.

Features of the present invention will be described below.

The headphone of the present invention includes the speaker unit, and the housing defining the internal space provided on the acoustic emission side as the back side of the housed speaker unit and the air chamber provided separately from the internal space. The housing includes the first housing member provided with the first hole allowing communication between the exterior and the air chamber, the second housing member attached to the speaker unit and coupled to the first housing member to define the internal space and the air chamber, and the third housing member fixed with the third housing member being sandwiched between the first and second housing members and provided with the second hole allowing communication between the air chamber and the internal space. Thus, the space inside the housing surrounding the back side of the speaker unit can communicate with the exterior.

The third housing member is preferably the substantially cubic member of which one side length is longer than the thickness dimension t2 of the inner wall portion dividing the air chamber and the internal space from each other, and is provided with the second hole defining the through-hole having the longer entire length than the thickness dimension t2. The third housing member is preferably fixed with the cutout portion of the inner wall portion being fitted. As a result, instable opening dimension and length of the second hole due to problems on dimension accuracy of the components forming the housing and assembly dimension accuracy of the housing can be avoided. Thus, the headphone can be configured with excellent reproduced sound quality and stable quality.

As in the above-described third housing member, the headphone may include the fourth housing member instead of the first housing member, the fourth housing member forming, at the outer wall portion, the first hole allowing communication between the exterior and the air chamber. Preferably, the fourth housing member is the substantially cubic member of which one side length is longer than the thickness dimension t1 of the outer wall portion dividing the exterior and the air chamber from each other, and is provided with the first hole defining the through-hole having the longer entire length than the thickness dimension t1. The fourth housing member is preferably fixed with the cutout portion of the outer wall portion being fitted. The fourth housing member can realize a long length of the first hole, and as a result, the headphone can be configured with excellent reproduced sound quality and stable quality.

The headphone of the present invention can realize along stable shape of the second hole formed at the inner wall portion of the housing, as well as providing excellent reproduced sound quality and stable quality.

DETAILED DESCRIPTION OF THE PREFERRED EMBODIMENTS

Hereinafter, headphones of preferred embodiments of the present invention will be described, but the present invention is not limited to these embodiments.

Figure 1:
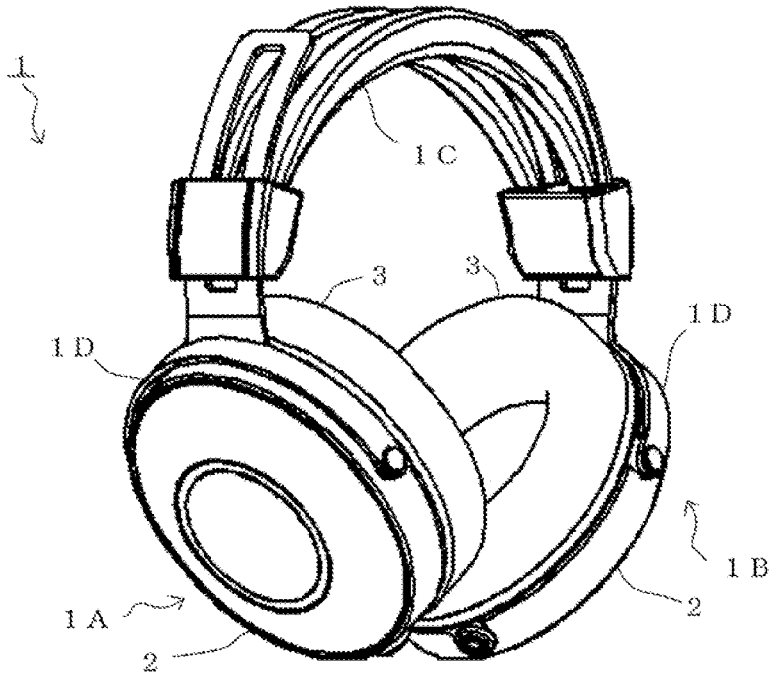
FIG. 1 is a view of an outer appearance of headphones of one embodiment of the present invention.

FIG. 1 is a view for describing headphones 1 of the preferred embodiment of the present invention. Specifically, FIG. 1 is a perspective view of an outer appearance of the headphones 1. Note that the form of the headphones 1 is not limited to the case of the present embodiment. Other configurations of the headphones 1 not necessarily described regarding the present invention will not be shown in the figures, and will not be described.

The headphones 1 of the present embodiment includes right and left headphone units 1A, 1B and a head band 1C coupling these headphone units 1A, 1B. Each of the headphone units 1A, 1B includes a housing 2 configured to house a speaker unit, and an ear contact portion 3. The headband 1C is connected to each coupling portion of hangers 1D, and each hanger 1D is coupled to a corresponding one of the housings 2.

The headphones 1 are provided with a (not-shown later-described) plurality of holes 2*a* at each side portion of the housings 2, and the holes 2*a* allow communication between an internal space of the housing 2 and the exterior of the housing 2 on the outside of the ear contact portion 3. Each headphone 1 can adjust compliance according to the internal space of the housing 2 by the holes 2*a*, and because of the adjusted compliance, can adjust frequency properties, specifically low frequency properties.

Figure 2:
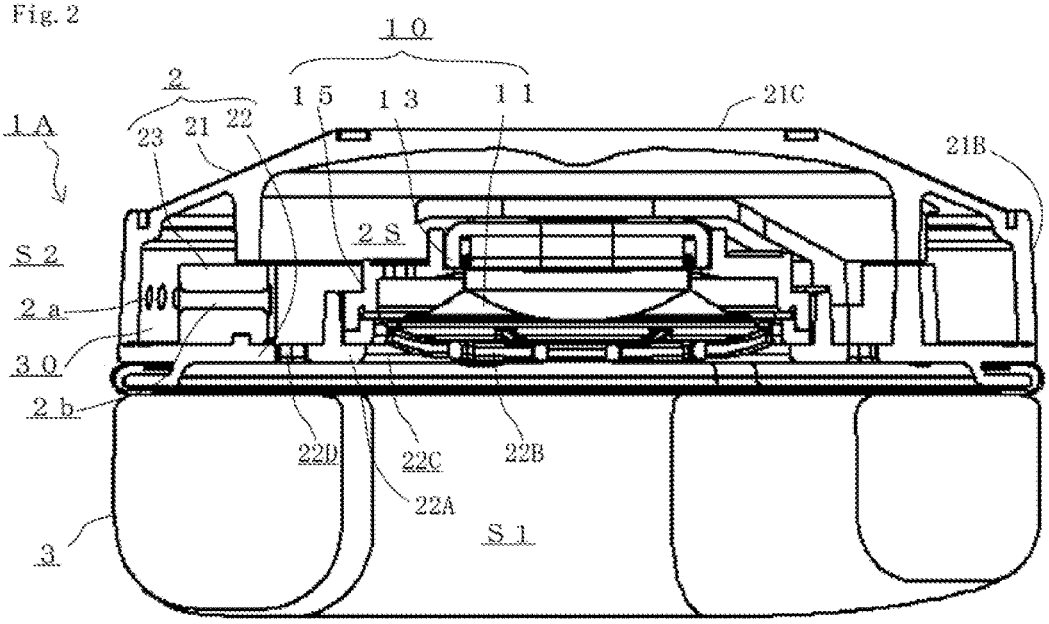
FIG. 2 is a view for describing a specific structure of the headphones of one embodiment of the present invention.
Figure 3:
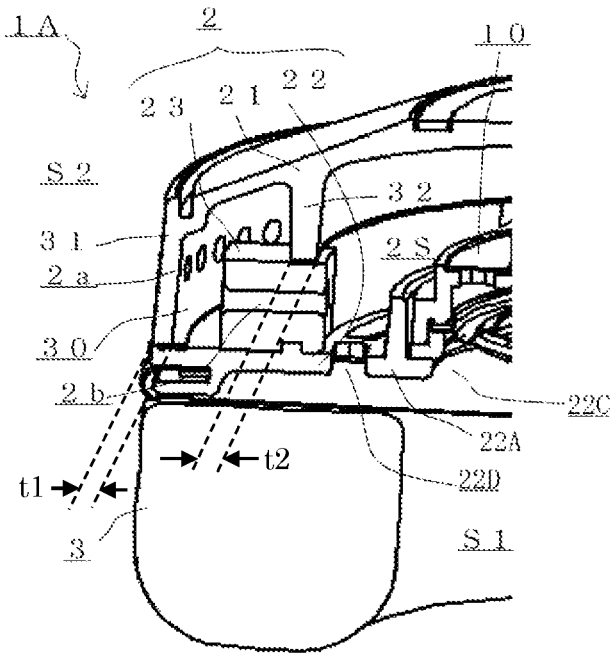
FIG. 3 is a view for describing the specific structure of the headphones of one embodiment of the present invention.
Figure 4:
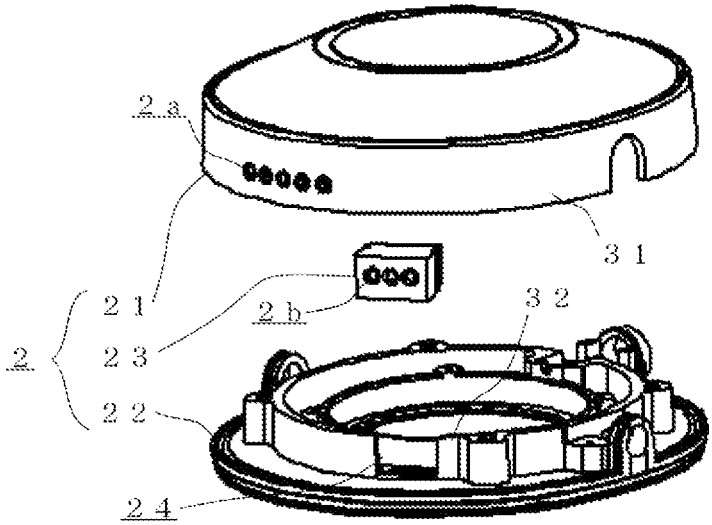
FIG. 4 is a view for describing the specific structure of the headphones of one embodiment of the present invention.

FIGS. 2 to 4 are views for describing a specific structure of the headphone 1 of one embodiment of the present invention. FIG. 2 is a sectional view of an internal structure of the headphone unit 1A as one of the headphone units. FIG. 3 is an enlarged sectional view of a configuration of an air chamber in the housing 2. Moreover, FIG. 4 is a view for describing a state in which each portion of the housing 2 and the ear contact portion 3 are separated from each other. FIG. 4 illustrates a configuration example of the headphone unit 1A with a speaker unit 10 and the ear contact portion 3 being removed.

As described above, the headphone units 1A, 1B of the headphones 1 each include the speaker unit 10, the housing 2 surrounding at least a back side of the speaker unit 10, and the ear contact portion 3 provided on a front side of the speaker unit 10.

The speaker unit 10 includes a diaphragm 11, a voice coil coupled to the diaphragm 11, a magnetic circuit 13 having a magnetic gap in which the voice coil is disposed, and a frame 15 configured to support an outer peripheral portion of the diaphragm 11 through an edge. The magnetic circuit 13 is supported by the frame 15, or is supported by a later-described coupling member 22. The magnetic circuit 13 includes a plate, a magnet, and a yoke. The above-described magnetic gap is formed between the plate and the yoke. A configuration of the speaker unit 10 is not limited to above, and various well-known forms such as a form in which a magnetic gap is formed between a magnet and a yoke can be employed.

The housing 2 includes the coupling member 22 coupled to the speaker unit 10, and a housing member 21 surrounding the back side of the speaker unit 10. The housing member 21 includes an outer peripheral cylindrical portion 21B and a planar portion 21C. The control unit 22 includes a support portion 22A configured to support the speaker unit 10. The support portion 22A protrudes inward of the housing 2, thereby supporting the frame 15 of the speaker unit 10. The hanger 1D is rotatably attached to the outer peripheral cylindrical portion 21B of the housing member 21.

The ear contact portion 3 includes an annular elastic member and a covering member configured to cover the elastic member. The ear contact portion 3 is attached to the housing 2 on an acoustic emission side of the speaker unit 10. The ear contact portion 3 contacts a listener's ear, thereby dividing the exterior of the housing 2 into an inner space (an external space S1) of the ear contact portion 3 and an exterior S2 on the outside of the ear contact portion 3. The external space S1 of the housing 2 on the inside of the ear contact portion 3 is a space communicating with the inside of the listener's ear. The exterior S2 of the housing 2 on the outside of the ear contact portion 3 is divided from an ear internal space by the ear contact portion 3.

In the headphone unit 1A (1B), an internal space 2S of the housing 2 communicates with the external space S1 of the housing 2 on the inside of the ear contact portion 3. Specifically, the internal space 2S is configured to include the housing member 21, the coupling member 22 coupled to the speaker unit 10, and a later-described hole formation member 23, these three members forming the housing 2. The internal space 2S of the housing 2 communicates with the external space S1 of the housing 2 on the inside of the ear contact portion 3 through an opening 22D formed at the coupling member 22 of the housing 2. In a case where the speaker unit 10 has a component exhibiting air permeability, such as the diaphragm 11, the internal space 2S of the housing 2 communicates with the external space S1 of the housing 2 on the inside of the ear contact portion 3 through such a component exhibiting the air permeability. Note that the opening 22D may be covered with a member exhibiting air permeability, such as non-woven fabric.

In the housing 2, an air chamber 30 is provided separately from the internal space 2S of the housing 2. The air chamber 30 may be provided on the inside or outside of the housing 2. For example, there are cases where the air chamber is provided on the inside of an outer peripheral surface of the housing 2 on the exterior side of the housing 2, an inner peripheral surface of the housing 2 on the internal space side of the housing 2, or the member forming the housing 2. The internal space 2S of the housing 2 communicates with the exterior S2 of the housing 2 on the outside of the ear contact portion 3 through the air chamber 30. The components of the housing 2 form the air chamber 30 in the present embodiment.

That is, the housing member 21, the coupling member 22 coupled to the speaker unit 10, and the later-described hole formation member 23 form the air chamber 30, these three members forming the housing 2. The internal space 2S of the housing 2 includes the above-described air chamber 30 as a first air chamber, and the above-described internal space 2S of the housing 2 as a second air chamber. The housing member 21 and the coupling member 22 define an inner wall portion 32 dividing the internal space 2S and the air chamber 30 from each other.

The housing 2 has, at a portion of a wall portion (a side portion) thereof, a double structure, and includes an outer wall portion 31 and the inner wall portion 32. The air chamber (the first air chamber) 30 is disposed between the outer wall portion 31 facing the exterior S2 of the housing 2 on the outside of the ear contact portion 3 and the inner wall portion 32 facing the internal space 2S of the housing 2. The outer wall portion 31 is provided with the first holes 2*a*, and in the illustrated example, the holes 2*a* are provided at the outer peripheral cylindrical portion 21B as the outer peripheral surface of the housing 2. The inner wall portion 32 includes the hole formation member 23 provided with second holes 2*b*.

The hole formation member 23 is a substantially cubic member of which one side length is longer than the thickness dimension t2 of the inner wall portion 32, and is fixed to the inner wall portion with the hole formation member 23 being sandwiched between the housing member 21 and the coupling member 22. In the present embodiment, the hole formation member 23 is a block-shaped member with a width of 15.0 mm, a depth of 10.0 mm, and a height of 7.0 mm, and is provided with the second holes 2*b* for communication between the internal space 2S and the air chamber 30 in a depth direction. Thus, each second hole 2*b* can form a through-hole of which entire length is longer than the dimension t2 of the inner wall portion 32.

With the long second holes 2*b* of the hole formation member 23, compliance according to the internal space 2S and the air chamber 30 in the housing 2 can be adjusted. With such adjusted compliance, the frequency properties, specifically low frequency properties, can be adjusted. The hole formation member 23 of the present embodiment is provided with three second holes 2*b*. The hole formation member 23 is the substantially cubic member, and therefore, the number of second holes 2*b* is adjusted so that the compliance can be adjusted.

Each of the housing member 21 and the coupling member 22 of the housing 2 is provided with a cutout portion 24, the hole formation member 23 being to be fitted in the cutout portions 24. Moreover, the hole formation member 23 is also provided with a groove portion, the cutout portions being to be fitted in the groove portion. The hole formation member 23 can be firmly attached to the inner wall portion 32, and therefore, instability of the opening dimension and length of each second hole 2*b* can be avoided.

In the illustrated example, the housing 2 is configured such that the components of the coupling member 22 and the components of the housing member 21 are connected together. The air chamber (the first air chamber) 30 is provided in the vicinity of a connection position between the coupling member 22 and the housing member 21. Specifically, the air chamber 30 is provided at the connection position between the coupling member 22 and the housing member 21 in a radial direction of the housing 2. A portion of the coupling member 22 and a portion of the housing member 21 may form the air chamber 30, or the entirety of the coupling member 22 and the entirety of the housing member 21 may form the air chamber 30.

The coupling member 22 includes the support portion 22A configured to support the speaker unit 10 on the housing 2, and a protection portion 22B facing an acoustic emission surface of the speaker unit 10. An opening 22C through which the diaphragm 11 of the speaker unit 10 is exposed is defined at the protection portion 22B. Each of the support portion 22A and the protection portion 22B is provided with the opening 22D. The openings 22D allow communication between the internal space 2S and the external space S1 of the housing 2.

In the illustrated example, a portion of the air chamber 30 is formed at the coupling member 22. The coupling member 22 is configured such that the inner wall portion 32 is provided close to the internal space 2S. The inner wall portion 32 close to the housing 2 is provided with the cutout portion 24 at which the hole formation member 23 is fixed to the inner wall portion 32 with the hole formation member 23 being sandwiched between the housing member 21 and the coupling member 22. A portion of the air chamber 30 is formed along an outer peripheral portion of the coupling member 22. In the illustrated example, a portion of the air chamber 30 is formed at two points of the coupling member 22.

The support portion 22A of the coupling member 22 supports the speaker unit 10 while being provided between an outer peripheral portion of the speaker unit 10 and the inner wall portion 32. Moreover, the support portion 22A of the coupling member 22 is disposed facing the ear contact portion 3. Further, the clearance 22D is provided between the ear contact portion 3 and the support portion 22A. The internal space 2S (the second air chamber) of the housing 2 communicates with the external space S1 of the housing 2 on the inside of the ear contact portion 3 through the clearance 22D and the opening 22D of the support portion 22A. With such a clearance 22D, the second air chamber (the internal space 2S) and the external space S1 of the housing 2 on the inside of the ear contact portion 3 can communicate with each other even when the support portion 22A of the coupling member 22 is covered with the ear contact portion 3. Thus, acoustic properties in a low sound range can be improved.

On the other hand, the air chamber 30 (the first air chamber) is provided on the exterior side of the housing 2 with respect to the opening 22C of the support portion 22A in the direction (the radial direction R) from the internal space 2S of the housing 2 toward the exterior S2 of the housing 2. Since the air chamber 30 is provided on the exterior side of the housing 2 with respect to the speaker unit 10, a space on a side close to the housing 2 can be saved, and the size of the speaker unit 10 can be increased as much as possible.

When the air chamber 30 is the first air chamber, the headphone 1 is configured such that the second air chamber (the internal space 2S) is provided between the inner wall portion 32 and the speaker unit 10. The second air chamber (the internal space 2S) communicates with the external space S1 of the housing 2 on the outside of the ear contact portion 3 through the first air chamber (the air chamber 30). Moreover, the second air chamber (the internal space 2S) communicates with the external space S1 of the housing 2 on the inside of the ear contact portion 3 through the opening 22D of the coupling member 22 or the component of the speaker unit 10 exhibiting the air permeability.

In the illustrated example embodiment, the air chamber 30 extends along an outer peripheral portion of the housing 2. The positions of the first holes 2*a* and the second holes 2*b* are preferably different from each other along the outer peripheral portion of the housing 2 such that the position of each first hole 2*a* allowing communication between the air chamber 30 and the exterior S2 of the housing 2 on the outside of the ear contact portion 3 and the position of each second hole 2*b* allowing communication between the air chamber 30 and the inside of the internal space 2S (the second air chamber) of the housing 2 do not face each other. According to this configuration, noise entering from the exterior S2 of the housing 2 on the outside of the ear contact portion 3 into the housing 2 is reflected on a wall portion of the air chamber 30, and then, a transmission path for a noise sound wave is refracted. That is, reflection etc. in the air chamber 30 can suppress the noise from entering the internal space 2S (the second air chamber) of the housing 2.

The headphone 1 of such an example embodiment is configured such that the internal space 2S of the housing 2 communicates with the exterior S2 of the housing 2 on the outside of the ear contact portion 3, and therefore, the size of the space on the side close to the housing 2 with respect to the speaker unit 10 can be substantially increased. Thus, properties of the speaker unit 10 in the low sound range can be improved. Although the noise enters from the exterior S2 of the housing 2 on the outside of the ear contact portion 3 into the internal space of the housing 2, the first air chamber (the air chamber 30) is provided on the noise transmission path between the exterior S2 of the housing 2 on the outside of the ear contact portion 3 and the internal space of the housing 2, and therefore, the noise transmitted to the external space S1 of the housing 2 on the inside of the ear contact portion 3 can be reduced. This can improve sound insulation of the headphones 1.

Note that in each headphone 1, the housing 2 may form the first holes 2*a* by means of the (not-shown) hole formation member fixed with the hole formation member being sandwiched between the housing member 21 and the coupling member 22. This hole formation member is provided at the outer wall portion 31 dividing the exterior of the housing member 21 of the housing 2 and the air chamber from each other, and therefore, the first holes 2*a* can be formed. The hole formation member can be a substantially cubic member of which one side length is longer than the thickness dimension t1 of the outer wall portion 31. The hole formation member is preferably fixed to the outer wall portion 31 with the hole formation member being sandwiched between the housing member 21 and the coupling member 22. The housing member 21 and the coupling member 22 may be provided with the cutout portions 24, the hole formation member being fitted in the cutout portions 24. Moreover, the hole formation member 23 may be also provided with the groove portion, the cutout portions being fitted in the groove portion. The hole formation member is provided with the first holes 2*a* as through-holes allowing communication between the exterior S2 and the air chamber 30 and having a longer entire length than the dimension t1 of the outer wall portion 31.

Figure 5:
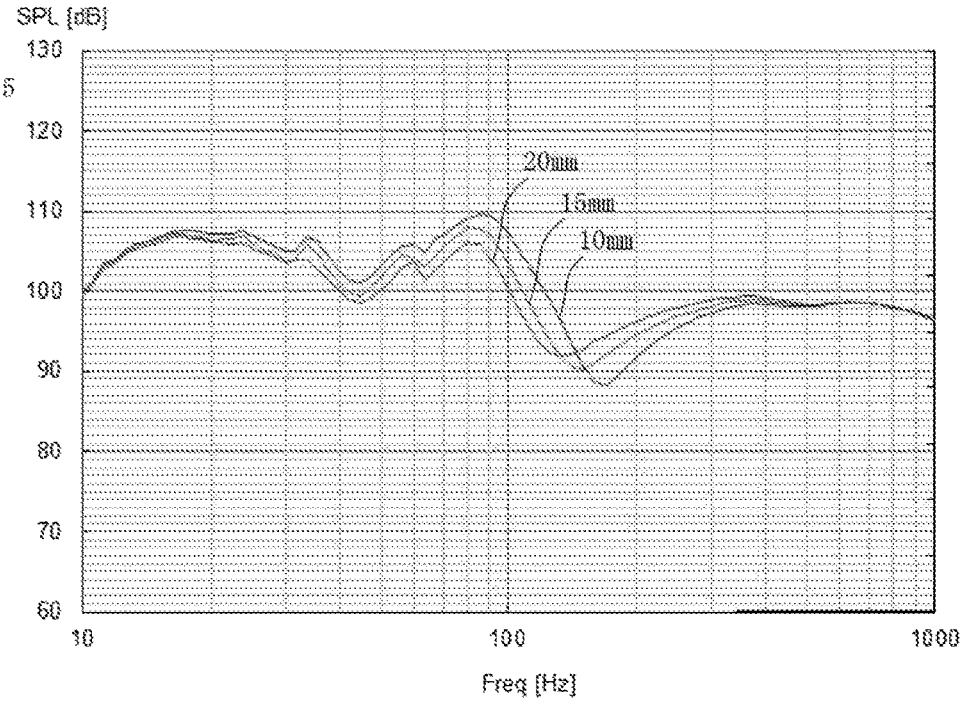
FIG. 5 is a graph showing acoustic pressure frequency properties of the headphones of one embodiment of the present invention.

FIG. 5 is a graph showing acoustic pressure frequency properties of the headphone 1. Specifically, FIG. 5 is a graph showing a change in acoustic pressure frequency properties of the hole formation member 23 forming the housing 2 of the headphone 1 in the case of changing the length of the second hole 2*b* allowing communication between the internal space 2S and the air chamber 30. In this case, the dimension t2 of the inner wall portion 32 of the housing 2 is about 2.0 mm, whereas the length of the second hole 2*b* is changed to 10 mm, 15 mm, and 20 mm longer than the dimension t2. As described above, the hole formation member 23 is the substantially cubic member of which one side length is longer than the thickness dimension t2 of the inner wall portion 32, and has the groove corresponding to the cutout portion 24 of the inner wall portion 32. Thus, the hole formation member 23 can be easily replaced, and the headphone 1 can exhibit optimal acoustic pressure frequency properties.

A longer length of the second hole 2*b* of the hole formation member 23 results in a smaller peak-dip level difference of the acoustic pressure frequency properties. Moreover, the substantially cubic member of which one side length is longer than the thickness dimension t2 of the inner wall portion 32 is used as the hole formation member 23, and as a result, instable opening dimension and length of the second hole 2*b* due to problems on dimension accuracy of the components forming the housing 2 and assembly dimension accuracy of the housing can be avoided. Thus, the headphones 1 can be configured with excellent reproduced sound quality and stable quality.

In FIG. 1, a cord and a plug portion of the headphones 1 for stereo reproduction are not shown. The headphones 1 may be wireless headphones including a reception section configured to receive a wireless signal without a cord and a plug portion for an audio signal supply.

The headphones of the present invention are not limited to the illustrated overhead type headphones, and may be headphones including another type of ear hook portion. Moreover, the present invention is not limited to the headphones, and is also applicable to earphones, canal type earphones, etc. Further, the headphones and the earphones of the present invention are not limited to stereo reproduction or multichannel surround reproduction for household use, and are also applicable to audio equipment for vehicle installation and sound reproduction facilities such as movie theaters.

What is claimed is:

1. A headphone comprising:

a speaker unit; and a housing defining an internal space provided on an acoustic emission side as a back side of the housed speaker unit and an air chamber provided separately from the internal space, wherein the housing includes a first housing member provided with a first hole allowing communication between an exterior and the air chamber, a second housing member attached to the speaker unit and coupled to the first housing member to define the internal space and the air chamber, and a third housing member fixed with the third housing member being sandwiched between the first and second housing members and provided with a second hole allowing communication between the air chamber and the internal space, wherein the first housing member and the second housing member define an inner wall portion dividing the air chamber and the internal space from each other, the third housing member is a substantially cubic member of which one side length is longer than a thickness dimension t2 of the inner wall portion, and is provided with the second hole defining a through-hole having a longer entire length than the thickness dimension t2, and the third housing member has a groove portion in which a cutout portion of the inner wall portion is fitted.

2. The headphone according to claim 1, wherein the housing further includes a fourth housing member fixed with the fourth housing member being sandwiched between the first and second housing members, and instead of the first housing member, the fourth housing member is provided with the first hole allowing the communication between the exterior and the air chamber.

3. The headphone according to claim 2, wherein the first housing member and the second housing member define an outer wall portion dividing the exterior and the air chamber from each other, and the fourth housing member is a substantially cubic member of which one side length is longer than a thickness dimension t1 of the outer wall portion, and is provided with the first hole defining a through-hole having a longer entire length than the thickness dimension t1.

4. The headphone according to claim 3, wherein the fourth housing member has a groove portion in which a cutout portion of the outer wall portion is fitted.

5. The headphone according to claim 1, further comprising:

an annular ear contact portion attached to the housing on the acoustic emission side of the speaker unit, wherein the housing and the ear contact portion define a space on an inside of the ear contact portion, the space communicating with an inside of a listener's ear and communicating with the exterior through the air chamber and the internal space.

6. A headphone comprising:

a speaker unit; and a housing defining an internal space provided on an acoustic emission side as a back side of the housed speaker unit and an air chamber provided separately from the internal space, wherein the housing includes a first housing member, a second housing member attached to the speaker unit and coupled to the first housing member to define the internal space and the air chamber, a third housing member fixed with the third housing member being sandwiched between the first and second housing members and provided with a second hole allowing communication between the air chamber and the internal space, and a fourth housing member fixed with the fourth housing member being sandwiched between the first and second housing members and provided with a first hole allowing communication between an exterior and the air chamber.

7. The headphone according to claim 6, wherein the first housing member and the second housing member define an outer wall portion dividing the exterior and the air chamber from each other, and the fourth housing member is a substantially cubic member of which one side length is longer than a thickness dimension t1 of the outer wall portion, and is provided with the first hole defining a through-hole having a longer entire length than the thickness dimension t1.

8. The headphone according to claim 7, wherein the fourth housing member has a groove portion in which a cutout portion of the outer wall portion is fitted.

* * * * *